US008266765B2

(12) United States Patent
Donoho

(10) Patent No.: US 8,266,765 B2
(45) Date of Patent: Sep. 18, 2012

(54) APPLIANCE DOOR HINGE

(75) Inventor: Joseph A. Donoho, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 266 days.

(21) Appl. No.: 12/721,601

(22) Filed: Mar. 11, 2010

(65) Prior Publication Data

US 2010/0229345 A1 Sep. 16, 2010

Related U.S. Application Data

(60) Provisional application No. 61/159,215, filed on Mar. 11, 2009.

(51) Int. Cl.
*E05F 1/08* (2006.01)

(52) U.S. Cl. ..... 16/286

(58) Field of Classification Search ..... 16/286, 16/287, 257, 260, 261, 263, 323, 324; 126/191, 126/192, 194; 49/386, 389
See application file for complete search history.

(56) References Cited

U.S. PATENT DOCUMENTS

| | | | | | |
|---|---|---|---|---|---|
| 2,579,091 | A | * | 12/1951 | Rinaldo | 16/245 |
| 2,845,923 | A | | 8/1958 | Nelson | |
| 3,006,335 | A | | 10/1961 | Keeling | |
| 3,067,736 | A | * | 12/1962 | Barefoot | 126/194 |
| 3,097,029 | A | | 7/1963 | Lotz et al. | |
| 3,127,889 | A | | 4/1964 | Mills | |
| 3,170,455 | A | | 2/1965 | Gass | |
| 3,299,879 | A | * | 1/1967 | Doner | 126/194 |
| 3,373,733 | A | * | 3/1968 | Harrington et al. | 126/191 |
| 3,521,319 | A | | 7/1970 | Fisher | |
| 3,677,259 | A | * | 7/1972 | Doner | 126/194 |
| 3,712,287 | A | * | 1/1973 | Summers, Jr. | 126/191 |
| 4,194,321 | A | * | 3/1980 | Hess | 49/389 |
| 5,341,542 | A | | 8/1994 | Hannan et al. | |
| 5,937,481 | A | * | 8/1999 | Faringosi | 16/332 |
| 6,393,664 | B1 | | 5/2002 | Habegger et al. | |
| 6,397,836 | B1 | | 6/2002 | Pelletier et al. | |
| 6,453,510 | B1 | | 9/2002 | Cummins et al. | |
| 6,789,293 | B2 | | 9/2004 | Habegger et al. | |
| 6,892,424 | B1 | | 5/2005 | Habegger et al. | |
| 6,968,597 | B2 | | 11/2005 | Habegger et al. | |
| 6,986,187 | B2 | | 1/2006 | Cummins et al. | |
| 7,134,169 | B2 | | 11/2006 | Habegger et al. | |
| 7,150,071 | B2 | | 12/2006 | Collene et al. | |
| 7,275,283 | B2 | * | 10/2007 | Kistner et al. | 16/286 |
| 2003/0172920 | A1 | | 9/2003 | Gronbach | |
| 2003/0213098 | A1 | | 11/2003 | Cummins et al. | |
| 2005/0155181 | A1 | | 7/2005 | Habegger et al. | |
| 2006/0032019 | A1 | * | 2/2006 | Kistner et al. | 16/286 |
| 2007/0101542 | A1 | | 5/2007 | Lee | |
| 2007/0119021 | A1 | | 5/2007 | Habegger et al. | |
| 2007/0232135 | A1 | | 10/2007 | Vanini | |
| 2007/0283532 | A1 | | 12/2007 | Vanini | |

* cited by examiner

*Primary Examiner* — Chuck Y. Mah
(74) *Attorney, Agent, or Firm* — Pearne & Gordon LLP

(57) ABSTRACT

An appliance hinge assembly includes: a support member configured to be secured to an appliance; a claw pivotally coupled to the support member; and a lock member pivotally coupled to the claw, wherein the claw and the lock member can be coupled together to create a bounded space therebetween.

20 Claims, 8 Drawing Sheets

APPLIANCE DOOR HINGE

CROSS-REFERENCE TO RELATED APPLICATIONS

The present application claims benefit of priority from U.S. Provisional Patent Application No. 61/159,215 titled Appliance Door Hinge filed on Mar. 11, 2009, which is incorporation herein by reference.

FIELD OF THE INVENTION

The present disclosure relates generally to hinge assemblies, and more particularly, to hinge assemblies for appliance doors.

BACKGROUND OF THE INVENTION

Appliances typically include one or more hinge assemblies for rotating a door on a horizontal axis from a closing condition, in which said door is vertically orientated, to an opening condition in which the door is set in an almost horizontal position. For instance, the appliance can be a cooking oven. Such hinge assemblies can comprise various features and structures, which in turn vary operability, reliability, durability, feel, etc. of the appliance door. For example, a door hinge may provide certain forces to a door to aid the opening or closing process.

BRIEF SUMMARY OF THE INVENTION

The following is provided to present a basic understanding of some example aspects of the present hinge assembly. This summary is not an extensive overview of the disclosure. Moreover, this summary is not intended to identify critical elements of the disclosure nor delineate the scope of the disclosure. The summary is to present some concepts of the disclosure in simplified form as a prelude to the more detailed description that is presented later.

In accordance with one example, an appliance hinge assembly includes: a support member configured to be secured to an appliance; a claw pivotally coupled to the support member; and a lock member pivotally coupled to the claw, wherein the claw and the lock member can be coupled together to create a bounded space therebetween.

In accordance with another example, an appliance hinge assembly includes: a support member; a claw pivotally coupled to the support member; a lock member pivotally coupled to the claw; a receptacle; and a pin secured to the receptacle, wherein the claw and the lock member are configured to trap the pin within a bounded space created by the claw and the lock member to retain the appliance hinge assembly in a first predetermined position.

In accordance with yet another example, an appliance hinge assembly is provided that includes: a support member; a claw pivotally coupled to the support member; and locking means for locking the appliance hinge assembly in first and second predetermined positions, the locking means being coupled to the claw.

DETAILED DESCRIPTION OF THE INVENTION

Figure 1:
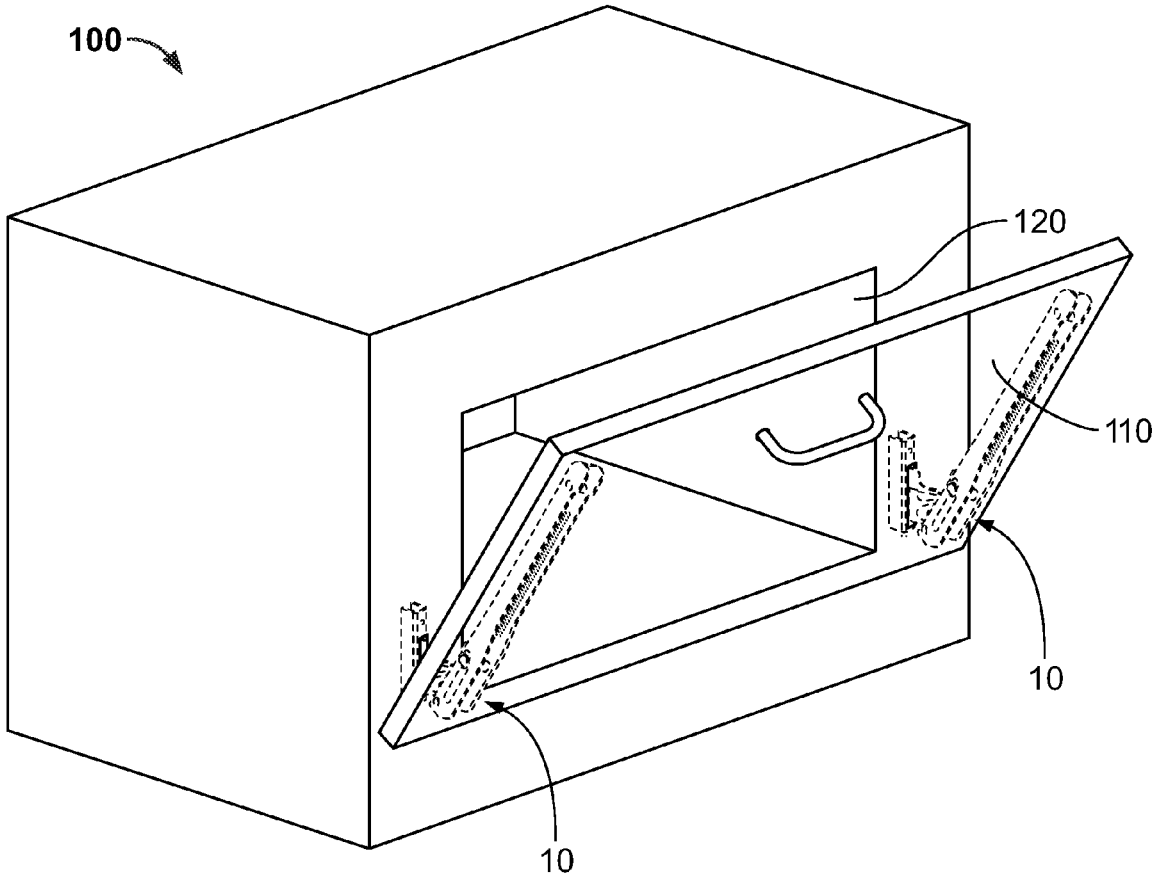
FIG. 1 is an illustration of an example embodiment of a home appliance implementing a hinge assembly.

The examples illustrated herein are not intended to be a limitation on the present disclosure. For example, one or more aspects of the hinge assembly can be utilized in other embodiments and even other types of devices. Moreover, certain terminology is used herein for convenience only and is not to be taken as a limitation on the present disclosure. Still further, in the drawings, the same reference numerals are employed for designating the same or similar elements.

FIG. 1 shows an example of an appliance 100 in which an appliance hinge assembly 10 can be implemented. The type of appliance 100 shown is a cooking oven but the hinge assembly described herein can be applicable to any device with a compartment that is closed by a door 110 such as a dishwasher, a furnace, a rotisserie, a kiln, or the like. In the present example, the door 110 is provided adjacent a cooking cavity 120. A pair of hinge assemblies 10 is coupled to the appliance body 100 at a front portion thereof. The hinge assemblies 10 can be located at a front bottom portion of the appliance 100 and spaced apart by a width that corresponds with a width of the appliance door 110. The hinge assemblies 10 are operable to facilitate movement of the appliance door 110 about a horizontal axis. Accordingly, the appliance door 110 can be rotated upward for closing and rotated downward for opening. The door can be configured to seal an opening of the cooking cavity 120 of the appliance 100. Although the present embodiment adopts such an arrangement of the door 110, a person of ordinary skill in the art will appreciate that the following description is equally applicable regardless of the orientation of the door 110 and the assembly 10. Other configurations of door rotation are, therefore, contemplated with this disclosure. For example, the door 110 may be rotated upward for opening and rotated downward for closing.

Figure 2:
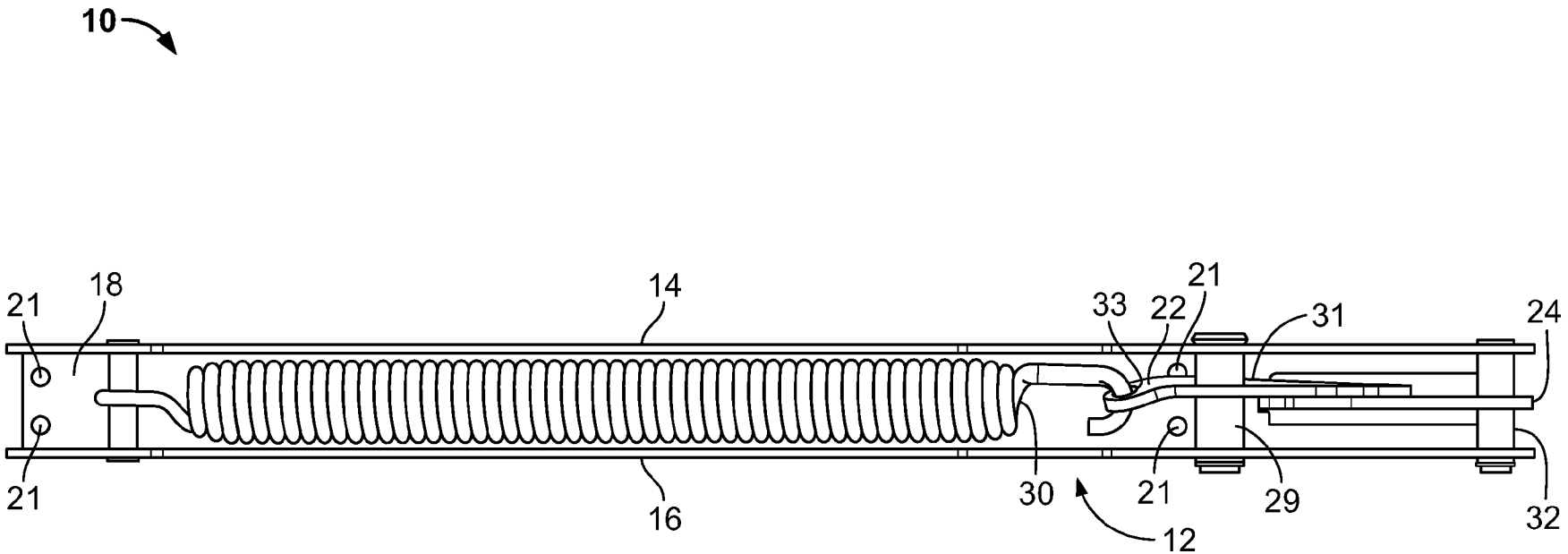
FIG. 2 is a rear view of an example appliance hinge assembly.

FIG. 2 illustrates a rear view of an example hinge assembly 10. The hinge assembly 10 may include a support member 12 that generally houses and/or supports various components of the hinge assembly 10. The support member 12 can be generally u-shaped in cross-section and includes a first sidewall 14, a second sidewall 16 substantially parallel to the first sidewall 14, and a front wall 18 adjoining the first and second sidewalls 14 and 16 to form the u-shape. Each of the first and second sidewalls 14 and 16 includes a slot 20 (shown in FIG. 3) provided therethrough. The support member 12 is sized to provide a secure connection between the appliance door 110 and the appliance body. For instance, the attachment between the appliance door 110 and the appliance body endures repeated loading from opening/closing of the appliance door 110. The front wall 18 may include one or more apertures 21 such that fastening means, such as screws, or nuts and bolts, etc. used to secure the support member 12 to a corresponding structure in the appliance 100. It is noted that any other suitable structure of method of securing the support member to the appliance 100 can be used.

A shaft 29 extends through and is slidable within the slots 20 provided in each of the first and second sidewalls 14 and 16. The shaft 29 also passes through a first aperture 31 provided in middle portion of a link member 22. Thus, the link member 22 is capable of both translational and rotational movement with respect to the shaft 29. The shaft 29 can be secured to and/or within the support member in any suitable manner. For instance, the shaft 29 can be held in place with a metal keeper, cotter pin, threaded fastener, or other methods as are known in the art. Additionally, the slots 20 shown herein may be instead provided as closed guide channels formed within the sidewalls and may not actually extend through the sidewalls as openings. The link member 22 includes a second aperture 33 at a first end portion of the link member 22. The second aperture 33 is configured to receive a first end portion of a biasing member 30, such as a coil spring. The second end of the link member 22 includes a third aperture 37 through which a pivot pin 34 extends. The pivot pin 34 also extends through a corresponding aperture in a claw 24 to pivotally connect the claw 24 with the link member 22. The claw 24 is connected directly to the support member 12 via a claw pivot pin 32, which can be secured to the support member 12 in a manner similar to shaft 29. The claw 24 is thus configured to pivot about the claw pivot pin 32.

The biasing member 30 is located in the channel defined by the u-shaped support member 12. The biasing member 30 is structured to bias the support member 12 toward a first operative position, as will be discussed in greater detail below, when attached to the appliance. As shown, the biasing member 30 can be a tension coil spring of metal wire; however other types of springs, such as compression springs, and materials, such as polymeric materials, can be employed. The biasing member can include a first hook member at a first end and a second hook member at the second end to secure the biasing member to the support member 12 at one end and to the link member 22 at the opposite end. It is to be appreciated that any suitable attachment structure can be used to secure the biasing member 30 within the hinge assembly, such as through soldering, welding, riveting, or other methods.

Figure 3:
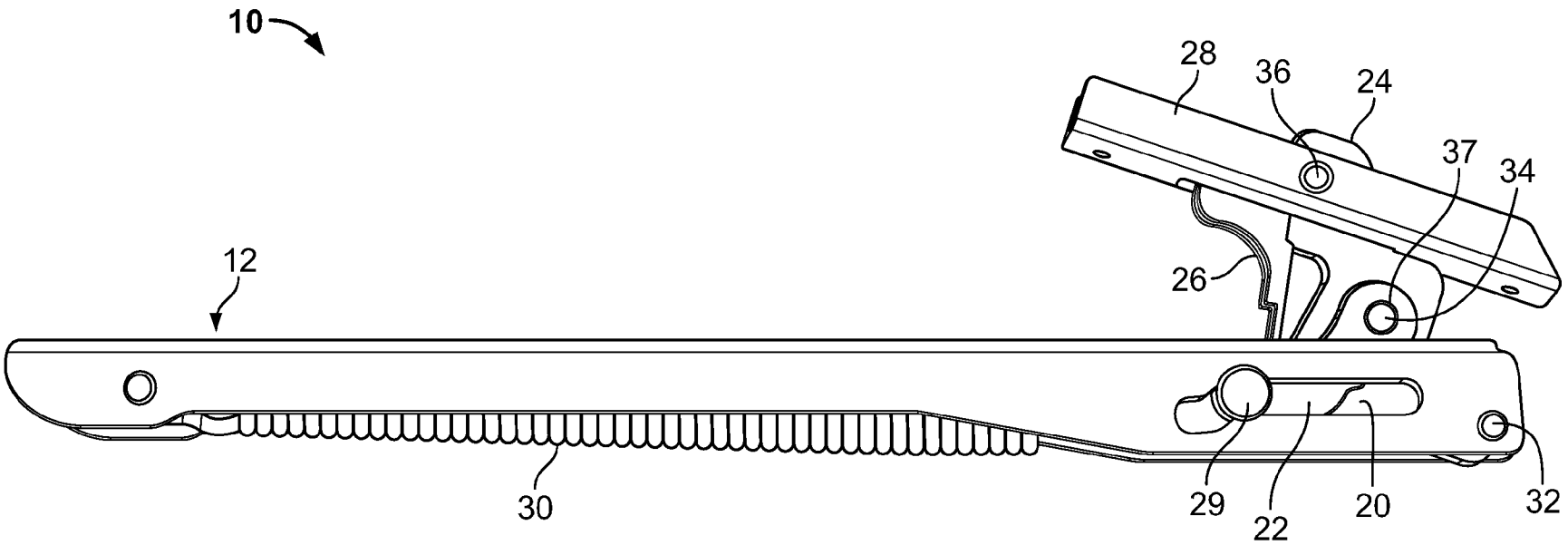
FIG. 3 is a side view of an example appliance hinge assembly.

Turning now to FIG. 3, a side view of the hinge assembly is shown. When positioned within the appliance 100, as shown in FIG. 1, the support member 12 is typically secured to the door 110 of the appliance 100 and a receptacle 28 is secured to the appliance body. The support member 12 and receptacle 28 can be secured to its respective structures via threaded fasteners, such as screws, but may alternately be secured via rivets, welding, or any other suitable structure and/or method.

Figure 8:
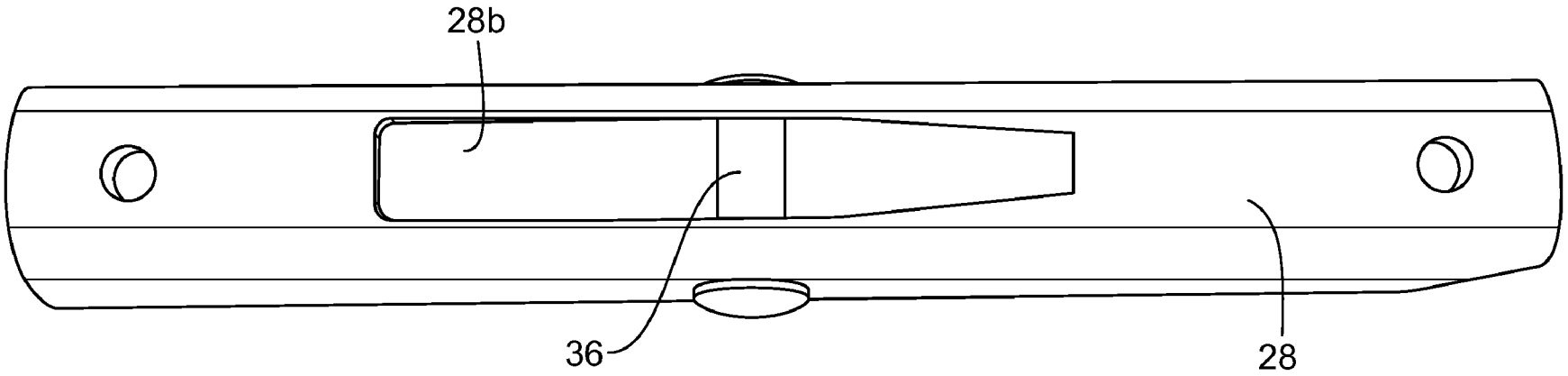
FIG. 8 is a front view of an example receptacle.

The claw 24 is configured to mate with the receptacle 28 such that it is releasably connected to corresponding portions of the receptacle 28, which is shown in greater detail in FIG. 8 herein. The claw can be of a one-piece stamped metal construction; however other materials and methods of manufacture can be used. As stated above, the claw 24 is pivotally connected to claw pivot pin 32, which connects the claw 24 to the support member 12. A first connecting pivot pin 34 couples the link member 22 and the claw 24, thus allowing the link member 22 and claw 24 to rotate about an axis through the first connecting pivot pin 34. Thus, when the claw 24 rotates about pin 32, the shaft 29 can be pulled along the slots 20, or channels, via the link member 22. The support member 12 is thus able to pivot relative to the claw 24 along an arc to and between at least a first operative position and a second operative position. As an example, the first operative position can be one in which the appliance door 110 is in a closed position with respect to the appliance cavity; and the second operative position can be one in which the appliance door 110 is in a fully open position with respect to the appliance cavity.

The hinge assembly 10 is also structured such that the appliance door 110 can be held in one or more intermediate positions located between the first and second operative positions. One such intermediate position can be a partially opened 'broil' position for a cooking oven. For instance, the slots 20 can include a curved portion at one end to act as a broil stop. FIG. 3 shows the shaft 29 of the link member 22 at the point where the slots 20 curve. In this position, the force applied by the biasing member 30 may not be sufficient to return the appliance door 110 to a closed position. In other words, the weight and location of the appliance door 110 may be sufficient to resist the biasing force and remain in a partially open position.

Figure 4:
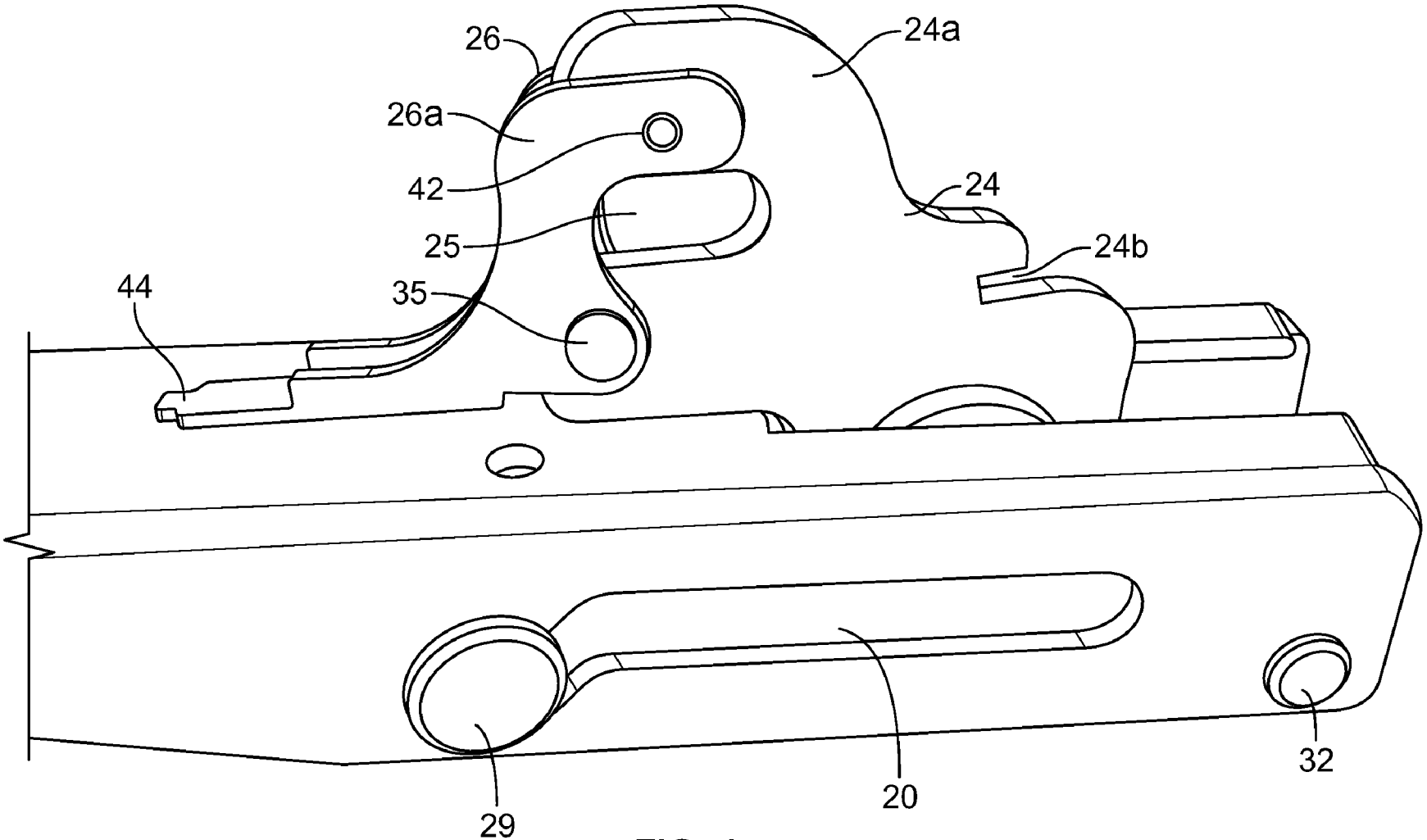
FIG. 4 is a perspective view of an example appliance hinge assembly in a closed orientation.
Figure 5:
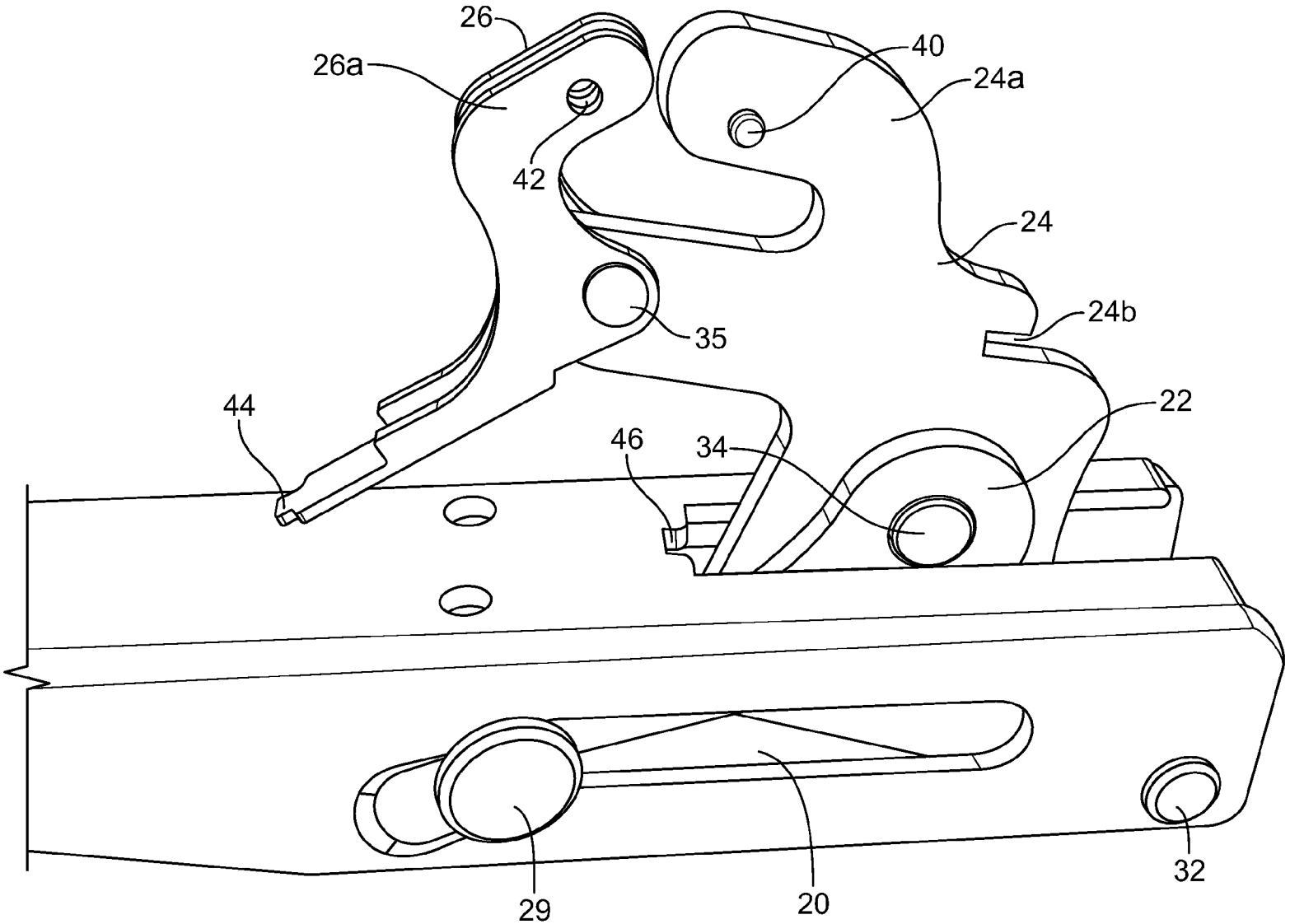
FIG. 5 is a perspective view of an example appliance hinge assembly in an open orientation.
Figure 6:
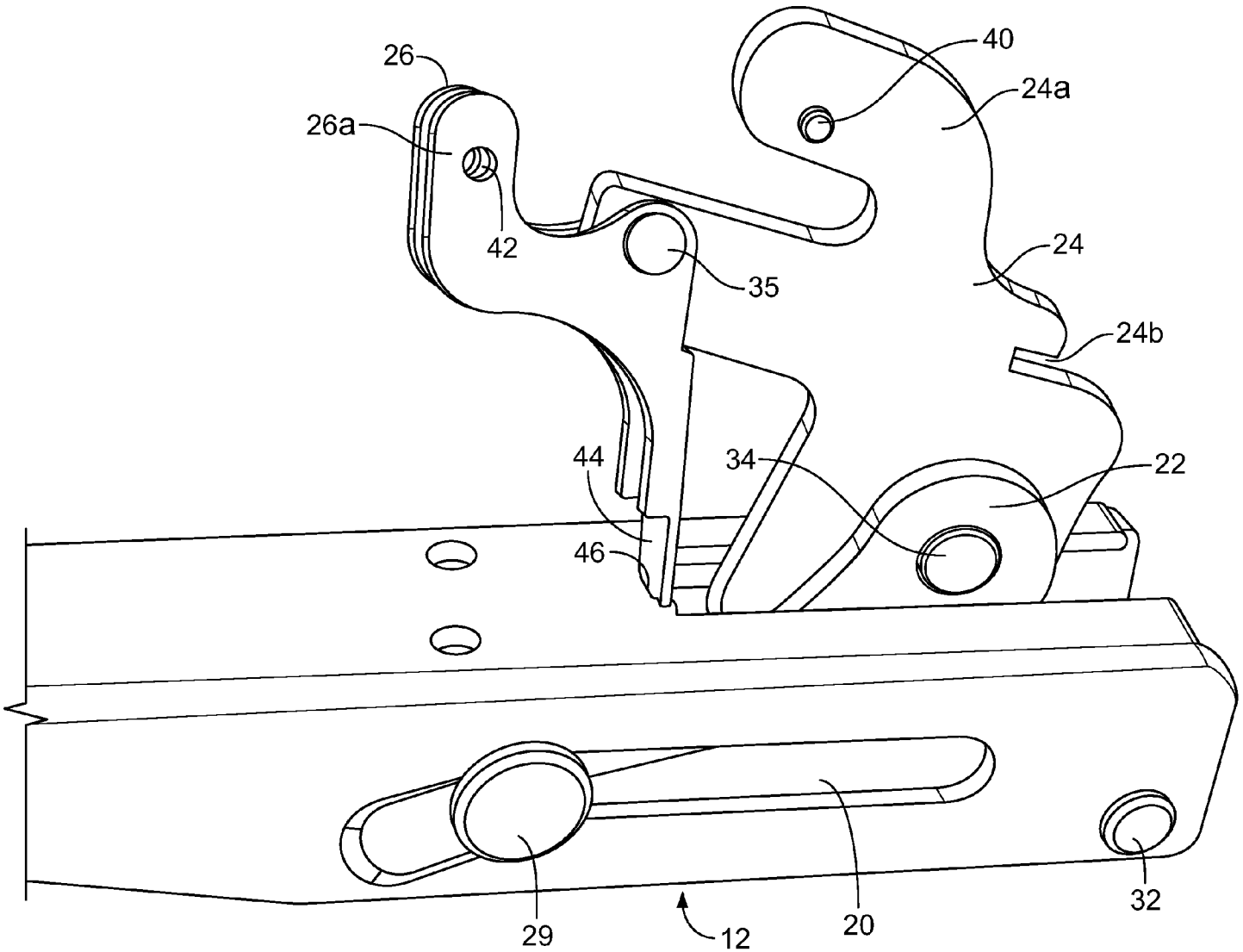
FIG. 6 is a perspective view of an example appliance hinge assembly in an open orientation and in a locked position.

The hinge assembly 10 further includes a lock member 26 that is pivotally coupled to the claw 24 via a second connecting pivot pin 35. FIGS. 4-6 illustrate the cooperation between the lock member 36 and the claw 24 in greater detail. Accordingly, the receptacle 28 is removed from these figures for ease of illustration. FIG. 4 illustrates the hinge assembly 10 in a first operative position. The shaft 29 is positioned at one end of slots 20 located nearest the biasing member 30. In this position, the claw 24 and the lock member 26 together create a bounded space 25. The bounded space 25 is formed by hook-shaped ends 24*a*, 26*a* of the claw 24 and the lock member 26, respectively. When coupled with the receptacle 28, a pin 36 of the receptacle 28 can be secured within this bounded space 25, as will be shown later.

As shown in FIG. 5, the hook-shaped end 24*a* of the claw 24 includes at least one protrusion 40 from its surface on at least one side. The hook-shaped end of the lock member 26 defines at least one hole 42 on at least one side. Alternately, hole 42 can be provided as a recess or detent, or as another alternative, both the protrusion 40 and hole 42 can be provided as holes and configured to receive a pin or other member that can secure the claw 24 and lock member 26 in position. The protrusions 40 and the holes 42 are configured to become aligned in at least one rotational position of the lock member 26 as it rotates about the axis of the second connecting pivot pin 35. When the protrusions 40 and the holes 42 align, the protrusions 40 extend a distance into the holes 42, thereby providing a snap engagement between the components. This interaction between the protrusions 40 and the holes 42 helps hold the lock member 26 in one location with respect to the claw 24. A predetermined amount of force is required to disengage the protrusions 40 from the holes 42, thus holding the lock member 26 in place and the receptacle pin 36 within the bounded space. Accordingly, when secured to the claw 24, the lock member 26 maintains the hinge assembly in its first operative position thus mitigating undesired opening of the appliance door, such as during shipping, installation, etc.

FIGS. 5 and 6 illustrate the lock member 26 in a partially open and fully open position, respectively. The lock member 26 includes a tab 44 at one end. As shown, the tab can comprise a narrow protrusion from the lock member 26. The tab 44 is configured to interact with a corresponding portion of the support member 12. In the present example, this corresponding portion is a notch 46. When coupled together, the interaction of the tab 44 and the notch 46 retains the lock member in an open position, as shown in FIG. 6 and the hinge assembly 10 in an intermediate operative position. When positioned within the notch 46, the tab 44 prevents motion of the claw 24 toward the support member 12, and keeps the hook-shaped end 24*a* of the claw 24 and the lock member 26 separated. While the claw 24 and the lock member 26 are in this open position, an operator can easily install or remove the appliance door 110 from the appliance 100 without removing unwieldy parts or screws or the need for special tools and also without worry that the hinge assembly will change positions.

The claw 24 further includes a recess 24*b* configured to engage a lower edge of an aperture 28*b* provided in the receptacle 28, as can be seen in FIG. 3.

Figure 7:
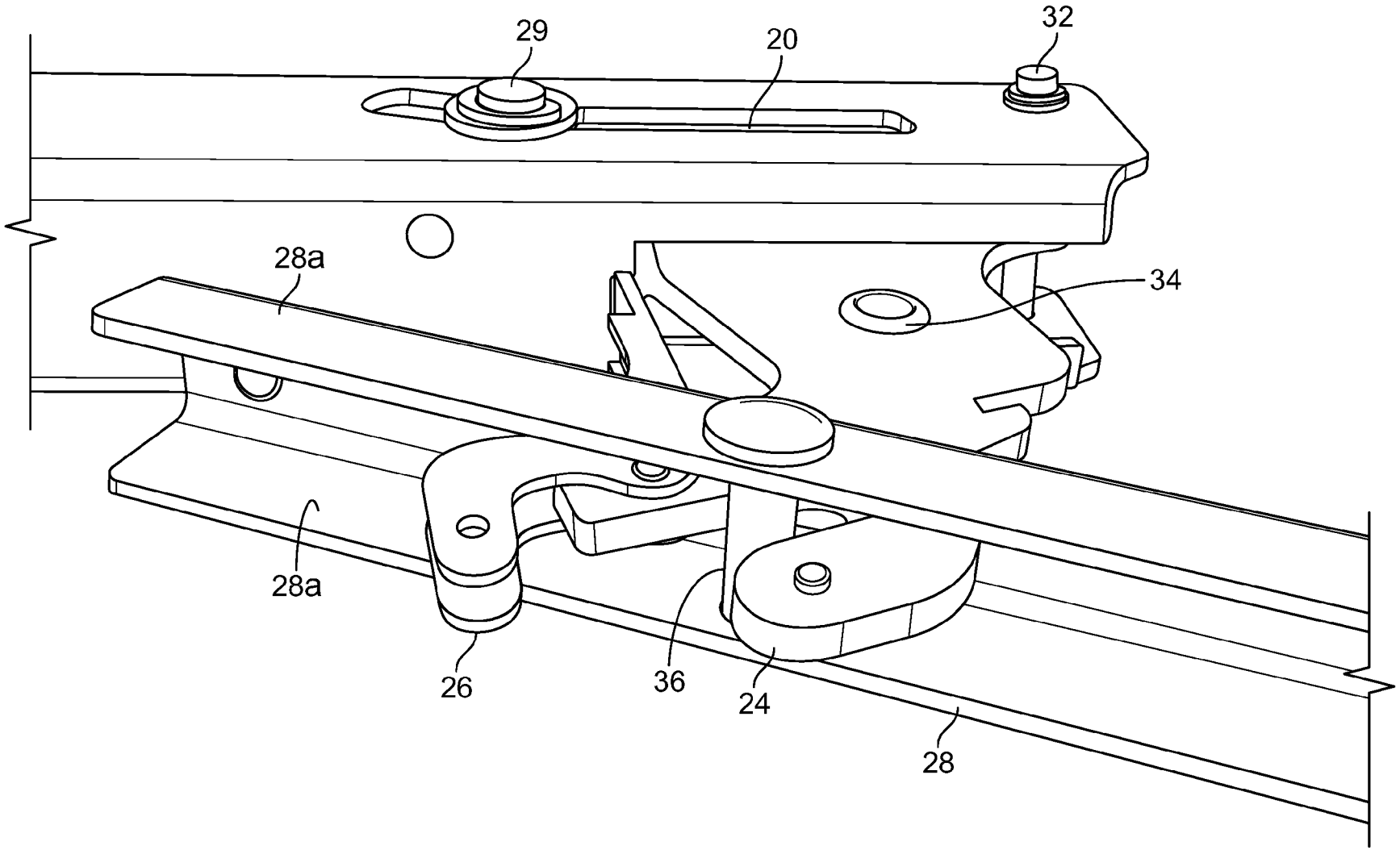
FIG. 7 is a perspective view of an example appliance hinge assembly coupled with an example receptacle.

FIG. 7 illustrates the cooperation of the claw 24, lock member 26, and receptacle 28 when the tab 44 of the lock member 26 is engaged with the notch 46 in the support member 12. When the lock member 26 is positioned in this open and locked position, the hinge assembly 10 is prevent from moving into the first operative, or closed, position. Thus, in this position, the appliance door 110 can be easily installed, or mounted, to the body of the appliance 100. In these positions, the receptacle 28 will be mounted in the appliance 100 while the first support member 12 will be mounted in the door 110. To install the door, the receptacle pin 36 is positioned within the hook-shaped end of the claw 24*a* and then the lower edge of the receptacle aperture 28*b* is seated in the recess 24*b* of the claw 24.

An example receptacle 28 is shown in FIG. 8. As discussed herein, the receptacle 28 includes an aperture 28*b* with a pin 36 positioned in a central portion of the aperture. As can be seen in FIG. 8, the receptacle 28 body has a substantially u-shaped cross section with first and section sidewalls. Accordingly, the pin 36 can extend from one sidewall of the receptacle 28 to the other. Additionally, one end of the aperture 28*b* can be narrowed to mitigate unwanted side-to-side motion of the receptacle 28 related to the support member 12. This narrowed end also facilitates ease of assembly as the desired position of the receptacle can be easily identified by the narrowed aperture end As discussed with respect to FIG. 1, the hinge assembly 10 can be mounted on opposing sides of an appliance door. Accordingly, the hinge assembly 10 for the one side of the door 110 may have some parts that are not identical but mirror the parts shown in each of the Figures for the opposing side of the door.

The disclosure has been described with reference to the examples above. Modifications and alterations will occur to others upon a reading and understanding of this specification. Examples incorporating one or more aspects of the disclosure are intended to include all such modifications and alterations.

The invention claimed is:

1. An appliance hinge assembly comprising:

a support member configured to be secured to a first part of an appliance;

a claw pivotally coupled to the support member;

a receptacle configured to be secured to a second part of the appliance; and a lock member pivotally coupled to the claw, wherein the claw and the lock member can be coupled together to create a bounded space therebetween and a part of the receptacle is configured to be releasably secured within the bounded space.

2. The appliance hinge assembly of claim 1, wherein the claw includes a hook-shaped end that cooperates with the lock member to create the bounded space therebetween.

3. The appliance hinge assembly of claim 1, wherein the lock member includes a hook-shaped end that cooperates with the claw to create the bounded space therebetween.

4. The appliance hinge assembly of claim 3, wherein the claw includes a hook-shaped end that cooperates with the hook-shaped end of the lock member to create the bounded space therebetween.

5. The appliance hinge assembly of claim 1, wherein the part of the receptacle is a pin and wherein, when the pin is secured within the bounded space, the support member can move relative to the receptacle.

6. The appliance hinge assembly of claim 5, wherein when the pin of the receptacle is secured within the bounded space, the hinge assembly is locked in a first operative position.

7. The appliance hinge assembly of claim 1, wherein one of the lock member and the claw includes at least one protrusion extending from a surface thereof and the other of the lock member and the claw includes at least one of a hole or a recess configured to receive the at least one protrusion therein.

8. The appliance hinge assembly of claim 1, further comprising a link member, the link member having a first end portion secured to a biasing member, a second end portion secured to the claw, and a middle portion coupled to a shaft.

9. The appliance hinge assembly of claim 8, wherein the support member defines a path of travel for the shaft.

10. The appliance hinge assembly of claim 9, wherein the path of travel includes a stop portion, the stop portion configured to stop an appliance door at a position intermediate a fully open and a fully closed position.

11. The appliance hinge assembly of claim 1, wherein the lock member includes a first end configured to lock with the claw and a second end configured to lock with the support member, wherein when the first end is locked with the claw, the hinge assembly is locked in a first position, and wherein when the second end is locked with the support member, the hinge assembly is locked in a second position.

12. An appliance hinge assembly comprising:

a support member;

a claw pivotally coupled to the support member;

a lock member pivotally coupled to the claw;

a receptacle; and a pin secured to the receptacle, wherein the claw and the lock member are configured to trap the pin within a bounded space created by the claw and the lock member to retain the appliance hinge assembly in a first predetermined position.

13. The appliance hinge assembly of claim 12, wherein each of the claw and the lock member includes a hook-shaped end configured for snap engagement with each other.

14. The appliance hinge assembly of claim 12, wherein the lock member includes an end portion having at least one hole through a surface thereof and wherein the claw includes an end portion having at least one protrusion extending from a surface thereof such that the at least one protrusion is configured to extend into the at least one hole when aligned.

15. The appliance hinge assembly of claim 12, wherein the lock member is further configured to engage a corresponding portion of the support member to retain the appliance hinge assembly in a second predetermined position.

16. The appliance hinge assembly of claim 15, wherein the lock member includes a tab configured for engagement with a notch provided in the support member.

17. The appliance hinge assembly of claim 12, wherein the receptacle includes an aperture, the aperture being tapered at one end to mitigate side-to-side motion of the receptacle with respect to the support member.

18. An appliance hinge assembly comprising:

a support member;

a claw pivotally coupled to the support member;

a receptacle configured to be engaged by the claw; and locking means for locking the appliance hinge assembly in first and second predetermined positions, the locking means being coupled to the claw.

19. The appliance hinge assembly of claim 18, wherein the locking means is configured to lock the claw to the receptacle to lock the appliance hinge assembly in the first predetermined position.

20. The appliance hinge assembly of claim 19, wherein the locking means is configured to engage the support member to lock the appliance hinge assembly in the second predetermined position.

* * * * *